US006473936B2

(12) United States Patent
Orita

(10) Patent No.: US 6,473,936 B2
(45) Date of Patent: Nov. 5, 2002

(54) DAMPING MECHANISM

(75) Inventor: Nobutoshi Orita, Itabashi-ku (JP)

(73) Assignee: Tok Bearing Co., Ltd., Tokyo (JP)

( * ) Notice: Subject to any disclaimer, the term of this patent is extended or adjusted under 35 U.S.C. 154(b) by 0 days.

(21) Appl. No.: 09/784,492

(22) Filed: Feb. 15, 2001

(65) Prior Publication Data

US 2001/0014993 A1 Aug. 23, 2001

(30) Foreign Application Priority Data

Feb. 17, 2000 (JP) ..... 2000-038921

(51) Int. Cl.[7] ..... E05F 5/02

(52) U.S. Cl. ..... 16/82; 16/54; 16/354; 16/86 B; 16/86 C; 16/337; 188/82.1; 188/82.5

(58) Field of Search ..... 16/82, 79, 62, 16/64, 69, 54, 86 B, 86 C, 354, 337; 292/DIG. 9; 188/82.1, 82.5; 49/212–214, 223, 281

(56) References Cited

U.S. PATENT DOCUMENTS 4,342,135 A * 8/1982 Matsuo et al. ..... 16/225
4,468,836 A * 9/1984 Omata ..... 16/82
4,570,617 A * 2/1986 Baus ..... 188/65.1
4,618,039 A * 10/1986 Omata ..... 16/82
4,763,385 A * 8/1988 Furch et al. ..... 16/58
4,987,793 A * 1/1991 Baumgarten et al. ... 188/196 D
5,809,697 A * 9/1998 Chen ..... 185/39
5,839,548 A * 11/1998 Parker et al. ..... 16/64
5,862,896 A * 1/1999 Villbrandt et al. ..... 16/49
6,131,242 A * 10/2000 Zipperle et al. ..... 16/82

FOREIGN PATENT DOCUMENTS

JP 9-13789 * 1/1997

* cited by examiner

*Primary Examiner*—Chuck Y. Mah
(74) *Attorney, Agent, or Firm*—Steinberg & Raskin, P.C.

(57) ABSTRACT

The present invention provides a damping mechanism capable of varying the moving speed of an openable door or the like in stages as necessary. Such damping mechanism includes a damping body (1) installed with a damper mechanism and allowing a rotative shaft (3) to protrude therefrom; a plurality of pinions (4, 5) provided on the rotative shaft (3) and each having a different diameter from one another; and a rack member (2) including a plurality of racks (7, 8) respectively engaging with the pinions (4, 5).

5 Claims, 5 Drawing Sheets

DAMPING MECHANISM

BACKGROUND OF THE INVENTION

1. Field of the Invention

This invention relates to a damping mechanism used for preventing, for example, an openable lid from receiving a shock when it is opened or closed and for adjusting the opening/closing speed of the lid.

2. Description of Related Art

For example, a vertically sliding type door is provided in a cup taking-out opening of a coffee vending machine. Such a door is designed to be moved up by hand for opening, and to fall under its own weight for closing when the hand is moved away from the door. If the door falls at extremely high speed to close, the user has to take out the cup while holding the door with his/her hand to keep it from falling.

For this reason, some vending machines use a one-way damper for an opening/closing portion of the door.

The one-way damper has a rotative shaft in a main body thereof. The rotative shaft readily rotates in one direction but has a damping effect in the other direction. As the torque applied in the damping direction increases, the rotational speed can be increased.

The mechanism of such a one-way damper will be explained in brief. A more specific configuration of this is disclosed in, for example, Japanese Patent Publication No. 6-68300.

The one-way damper has a tubular external frame and an inner frame which is built into the external frame and into which a rotative shaft is inserted. Further, the space between the assembled external and inner frames is filled with filler for causing resistance in the production of relative rotation.

On the inner circumference of the inner frame, internal gear teeth are provided, and a plurality of gears are mounted between the internal gear teeth and the above rotative shaft. The inside of the inner frame is configured such that the gears rotate or stop depending on the rotating direction of the rotative shaft.

Therefore, when the rotative shaft is rotated in one direction, the gears in the inner frame are easily rotated along the internal gear teeth, and thus the rotation between the rotative shaft and the inner frame is not interfered with. In other words, the rotative shaft readily rotates in relation to the inner frame, and in this situation, the inner frame and the external frame are integrated.

However, when the rotative shaft is rotated in the other direction, the gears in the inner frame are locked so as to limit the relative rotation of the rotative shaft to the inner frame. In this case, if the applied torque overcomes the resistance between the inner and external frames, the rotative shaft and the inner frame are integrated and rotate relative to the external frame. The resistance between the external frame and the inner frame acts as a brake to exert a damper function.

The following explanation is given for a manner of using the above one-way damper in a door of a vending machine.

A damper body is secured in a main body of the vending machine. A pinion is arranged on the rotative shaft protruding from the damper body, and a rack engaging with the pinion is provided in the door. The rack and the pinion are positioned such that the rack is engaged with the pinion within the range of the vertical movement of the door.

The one-way damper is mounted such that the rotative shaft freely rotates when the door is moved up by hand for opening and the rotative shaft rotates in a direction of limiting the rotation when the door closes. As a result, when the door is moved up, the door can be opened with little resistance, and when the door closes under its own weight, the door falls slowly due to the exerted damper mechanism.

In this way, since the door does not fall immediately after being moved up and opened, it is possible to remove a cup from the vending machine while the hand is moved away from the door.

Using the one-way damper as described above, it is possible to decrease the closing speed of the vertically sliding type door.

Further, it is needed not to allow the door to fall while the cup is being taken out from the coffee vending machine. For this need, a one-way damper capable of allowing a sufficiently large torque for reducing the falling speed is selected.

However, when the above one-way damper is used, the closing speed of the door is constant through all the closing steps. Accordingly, the use of a one-way damper capable of allowing a large torque in order for the door not to close immediately produces the disadvantage that the door does not close for a while after the cup has been taken out.

Again, if the door remains open for a long time, it produces another disadvantage in that it becomes impossible to immediately brew coffee for the next cup and it allows dust to enter the vending machine.

SUMMARY OF THE INVENTION

It therefore is an object of the present invention to provide a damping mechanism which is capable of varying the moving speed of an openable door or the like in stages as necessary.

A damping mechanism according to the present invention is featured by including a damper body installed with a damper mechanism and allowing a rotative shaft to protrude therefrom; a plurality of pinions provided on the rotative shaft and each having a different diameter from one another; and a rack member including a plurality of racks respectively engaging with the pinions.

According to the present invention, the moving speed of the door or the like having the damper function is adjusted in a plurality of steps. This allows the door or the like to move at speeds further appropriate to practical use, not at a speed too low or high.

DETAILED DESCRIPTION OF THE PREFERRED EMBODIMENTS

Figure 1:
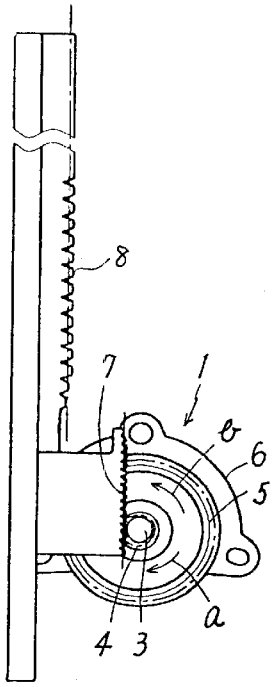
FIG. 1 is a front view of an essential part in a first embodiment according to the present invention.

A first embodiment shown in FIG. 1 to FIG. 4 is a damping mechanism having a combination of a damper body 1 and a door 2.

The damper body 1 is installed therein with a damper mechanism (not shown) as explained in Description of Related Art. When a rotative shaft 3 protruding from the damper body 1 rotates in the direction indicated with the arrow a, resistance does not occur, whereas only when it rotates in the direction indicated with the arrow b, a brake is exerted to decrease the rotational speed.

Further, on the outer circumference of the rotative shaft 3, a small-diameter pinion 4 and a large-diameter pinion 5 are provided at different positions offset in the axis direction.

On the door, a first rack 7 engaging with the small-diameter pinion 4 and a second rack 8 engaging with the large-diameter pinion 5 are placed. The first and second racks 7 and 8 are situated at different positions offset in the lateral direction and also in the longitudinal direction in correspondence with the position of the pinions respectively engaging therewith. Hence, when the door 2 moves vertically, the first and second racks 7 and 8 engage in turn with the corresponding pinions 4 and 5 provided on the damper body 1. The first and second racks 7 and 8 rotate the pinions 4 and 5 so as to rotate the rotative shaft 3.

In the first embodiment, the door 2 is a rack member of the present invention. It should be noted that reference numeral 6 in the drawings represents a mounting plate which is secured to a main body of a vending machine or the like.

The small-diameter pinion 4 and the large-diameter pinion 5 having different diameters apply different torque to the rotative shaft 3. The rotational torque is proportional to a distance from the rotating center to the force point, namely a radius. For this reason, the rotative shaft 3 receives a larger torque from the rotation of the large-diameter pinion 5 than from the rotation of the small-diameter pinion 4.

Next, the operation of the above damping mechanism will be explained.

Figure 2:
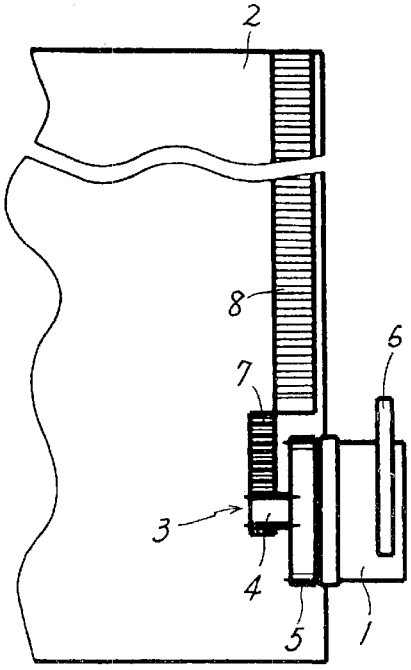
FIG. 2 is a sectional view of the first embodiment and illustrates when. a door opens fully.

FIG. 1 and FIG. 2 illustrate the state of the door 2 moved up to the highest position. When the door 2 is moved up to the highest position, the first and second racks 7 and 8 arranged on the door 2 respectively rotate the pinions 4 and 5 in the rotating direction indicated with the arrow a in FIG. 1. Accordingly, at this time, the damper function is not exerted. In other words, the door can be smoothly opened without resistance.

If the hand is moved away from the door 2 under the above conditions, the door 2 falls under its own weight.

In this event, initially the first rack 7 provided on the door 2 engages with the small-diameter pinion 4 to rotate the rotative shaft 3 in the direction of the arrow b in FIG. 1. Since an external force in the direction of the arrow b is applied to the rotative shaft 3, resistance acts on the rotation of the rotative shaft 3. As a result, the door 2 falls very slowly.

Figure 3:
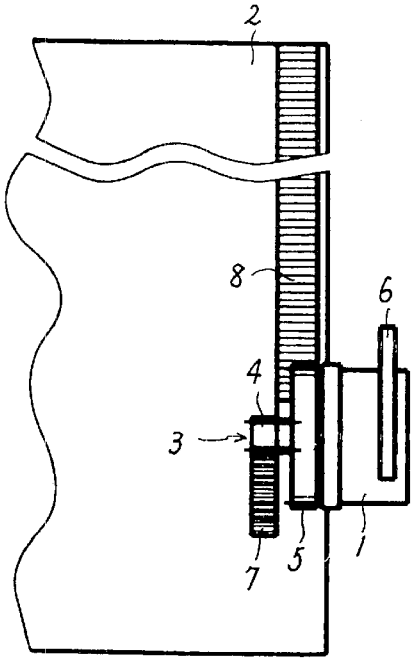
FIG. 3 is a sectional view of the first embodiment and illustrates when the door moves further down than that of the state in FIG. 2.

As shown in FIG. 2, the door 2 moves down along the small-diameter pinion 4 until the top end of the first rack 7 reaches the small-diameter pinion 4. Then, as shown in FIG. 3, the second rack 8 engages with the large diameter 5. Thereafter, as shown in FIGS. 3 and 4, while the second rack 8 rotates the large-diameter pinion 5, the door 2 moves down.

Figure 4:
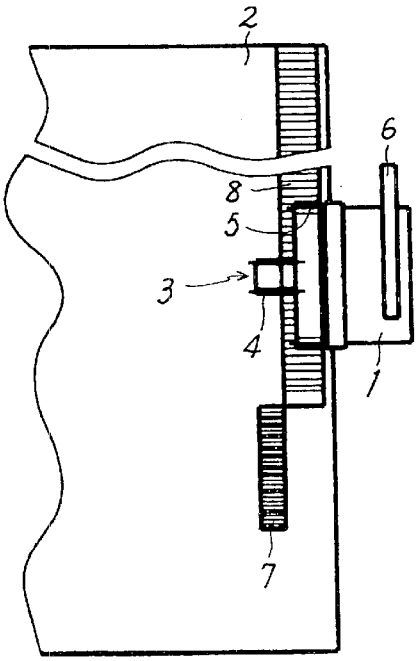
FIG. 4 is a sectional view of the first embodiment and illustrates when the door moves further down than that of the state in FIG. 3 and the moving speed is changed.

When the second rack 8 engages with the large-diameter pinion 5 as shown in FIGS. 3 and 4, the rotative shaft 3 receives a larger rotational torque than that in the state shown in FIGS. 1 and 2 as described in the foregoing paragraph. In other words, the external force for rotating the rotative shaft 3 in the direction of the arrow k (see FIG. 1) increases. Or, to explain it differently, the rotational speed of the rotative shaft 3 increases at the time when the second rack 8 engages with the large-diameter pinion 5, and thus the downward movement of the door also increases in speed.

If the damping mechanism as described in the first embodiment is used, this allows the closing speed of the door 2 to be controlled in two steps. Initially, the door closes very slowly. At some midpoint, the door can close a little faster than at the start. If such a door 2 is installed in a coffee vending machine or the like, the door does not remain open for a long time after a coffee cup has been removed. As a matter of course, the door is opened without resistance, and does not move down for closing until the cup has been taken out.

Figure 5:
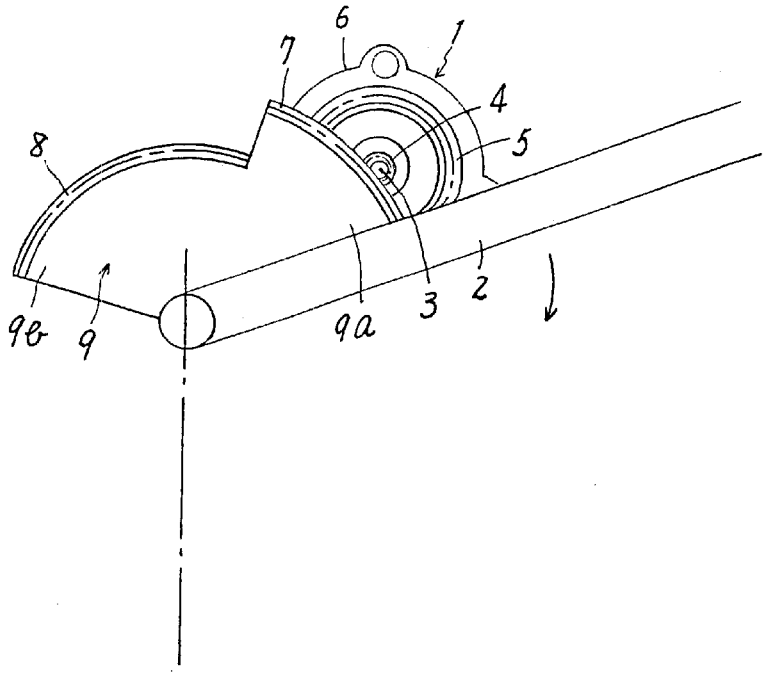
FIG. 5 is a sectional view of a second embodiment and illustrates when a door opens fully.
Figure 6:
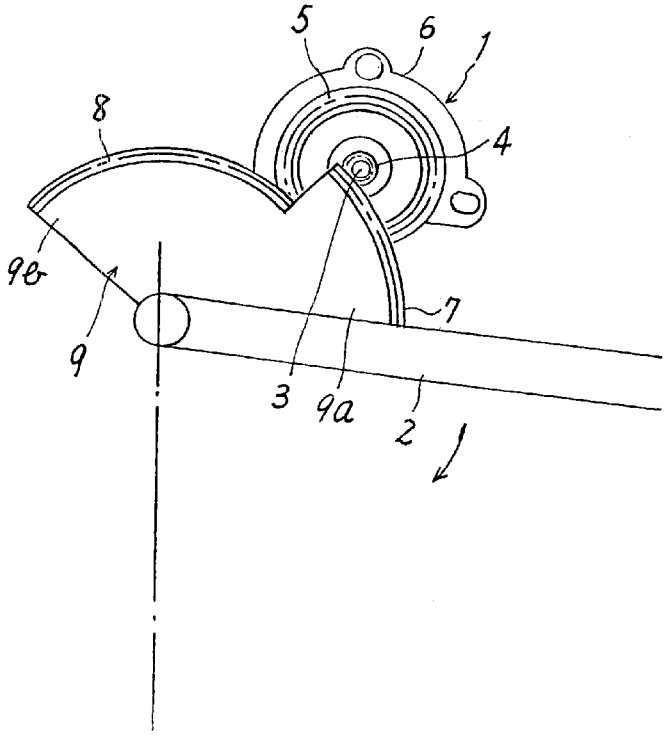
FIG. 6 is a sectional view of the second embodiment and illustrates when the door moves further down than that of the state in FIG. 5.
Figure 7:
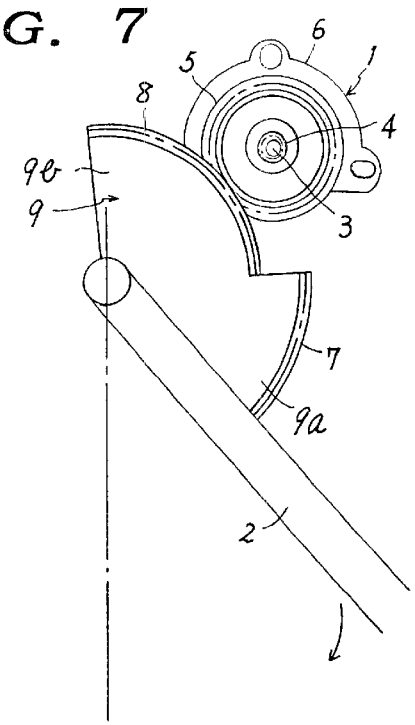
FIG. 7 is a sectional view of the second embodiment and illustrates when the door moves further down than that of the state in FIG. 6 and the moving speed is changed.

A second embodiment illustrated in FIG. 5 to FIG. 7 is different from the first embodiment in that a fan-shaped rack member 9 is provided in a door 2. The door 2 is not the vertical sliding type but a rotationally opening/closing type. The configuration of the damper body 1 and other parts is the same as that in the first embodiment.

The rack member 9 is composed of fan-shaped portions 9*a* and 9*b* having different diameters. On the outer circumferences of the fan-shaped portions 9*a* and 9*b*, a first rack 7 and a second rack 8 are provided respectively. The first rack 7 and the second rack 8 are respectively situated at the different positions offset along the axis direction of the rotative shaft 3 to engage with a small-diameter pinion 4 and a large-diameter pinion 5 provided on the damper body 1.

Incidentally, the alternating short and long dash line in the drawing represents a vertical line.

In the second embodiment, the movement of the door 2 can be adjusted in two steps in the entire process from the state when the door 2 is moved up for opening to the state when the door closes after the hand is moved away from the door 2. In the fully opening state of the door as shown in FIG. 5, the first rack 7 engages with the small-diameter pinion 4. Here, when the weight of the door 2 itself acts as the rotational torque on the rotative shaft 3 through the first rack 7 and the small-diameter pinion 4, the rotative shaft 3 rotates at a very low speed to slowly move down the door 2.

The first rack 7 moves engaging with the small-diameter pinion 4 until the end of the first rack 7 reaches the small-diameter pinion 4. Then the second rack 8 in turn engages with the large-diameter pinion 5 as shown in FIG. 6. At this time, since the large-diameter pinion 5 rotates, the rotational torque acting on the rotative shaft 3 increases, resulting in increasing the rotational speed. Accordingly, the closing speed of the door 2 is increased.

Figure 8:
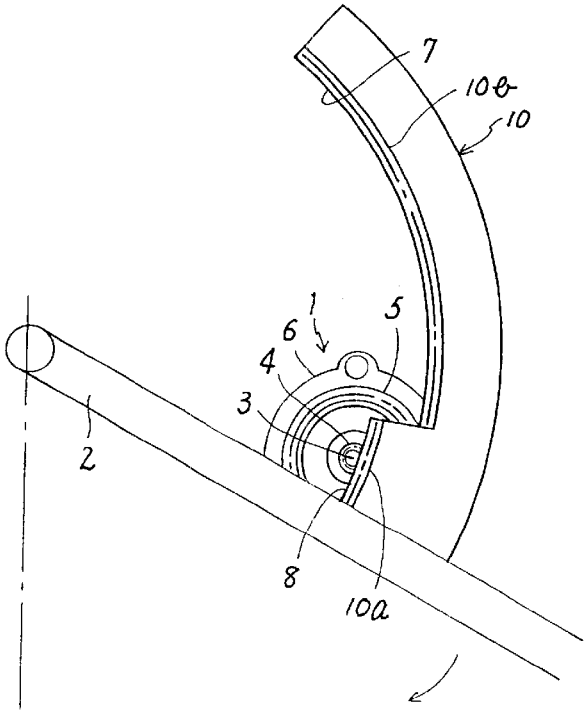
FIG. 8 is a sectional view of a third embodiment and illustrates when a door opens almost fully.
Figure 9:
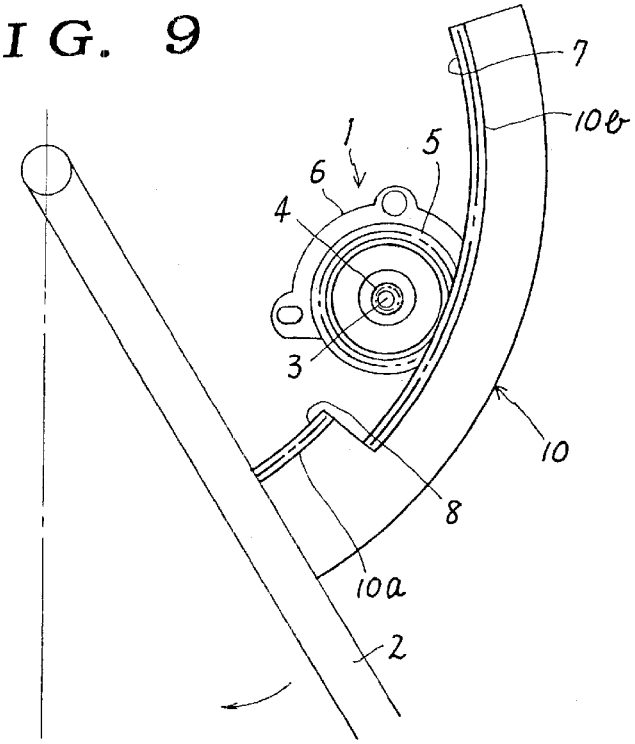
FIG. 9 is a sectional view of the third embodiment and illustrates when the door moves further down than that of the state in FIG. 8 and the moving speed is changed.
Figure 10:
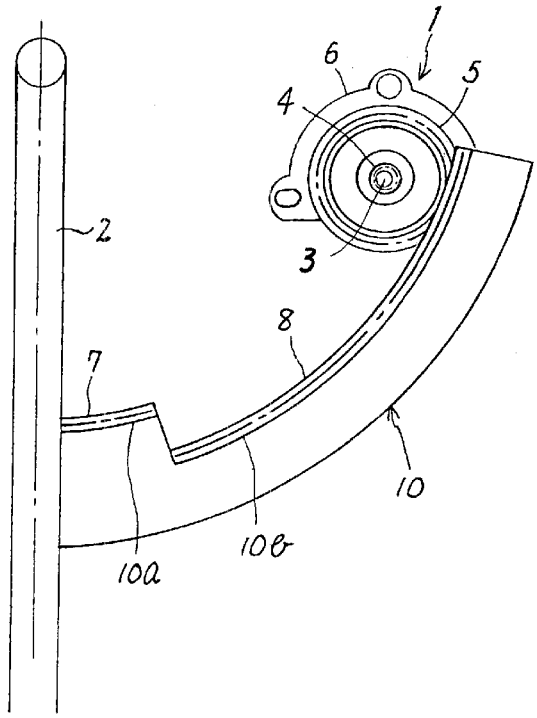
FIG. 10 is a sectional view of the third embodiment and illustrates when the door moves further down than that of the state in FIG. 9 to close.

A third embodiment illustrated in FIG. 8 to FIG. 10 is different from the second embodiment in a shape of a rack member 10 provided in a door 2 but the same in other parts as those of the second embodiment.

The rack member 10 is provided with two arcs 10*a* and 10*b* having different diameters. On the insides of the arcs, first and second racks 7 and 8 are provided respectively.

As in the first and second embodiments, the rotation of the rotative shaft 3 is faster in the engagement of the second rack 8 with the large-diameter pinion 5 than in the engagement of the first rack 7 with the small-diameter pinion 4.

Therefore, in the state of FIG. 8 in which the door 2 is opened fully, the first rack 7 engages with the small-diameter 4 to start closing the door 2 at a very low speed. After that, upon the engagement of the second rack 8 with the large-diameter pinion 5, the door 2 closes slightly faster.

As described above, according to the damping mechanism of the first to third embodiments, the moving speed of the door can be controlled in two levels. Those embodiments require a large and a small type of pinion on the rotative shaft 3 to accomplish two levels of the rotational speed. If the number of types of pinion diameters is increased, this allows the rotational speed to be controlled to more levels.

It is possible to adjust the rotation at a low speed at the start and then at a higher speed in the latter half as in the aforementioned embodiments, or even vice-versa, or the rotation at a low speed at the start, then at a higher speed midway, and then at a low speed at the end.

To sum up, when the diameters of the pinions provided on the rotative shaft of the damper body are varied to set the rotational torque acting on the rotative shaft, the rotational speed, namely, the moving speed of the door or the like can be selectively set.

The aforementioned embodiments have been explained in reference to the case where in the rotation in the direction of exerting the damper function the weight of the door itself is used to rotate the rotative shaft. However, the present invention can be applied to a door closed by hand. For example, the present invention can be used so that the door cannot be slammed shut by hand. In this case, the user feels some resistance when closing the door. The degree of resistance varies in accordance with the different diameters of the pinions.

Further, the damper function may be exerted not only in closing the door, but also in opening the door or both in closing and in opening the door.

For example, a laterally sliding door is sometimes required to move slowly and gently at the final stage of the opening or closing process. In this event, if the diameters of the pinions are varied such that the door is moved at a very low speed in the start and the end and at a slightly higher speed midway, it is possible to prevent the occurrence of shock at the final points in the both closing and opening directions.

However, when the moving speed in the closing/opening direction is adjusted, the damper function exerting in the both closing and opening directions is required to mount in the damper body.

Further, the moving object is not limited to doors.

The present invention has been described herein with reference to preferred embodiments of the invention however the description provided herein is for illustrative purposes and should not be considered to be exhaustive. It is understood that modifications and variations of the above describe preferred embodiments are possible without departing from the spirit or scope oft he present invention.

EXPLANATION OF REFERENCE NUMERALS

1 DAMPER BODY
2 DOOR
3 ROTATIVE SHAFT
4 SMALL-DIAMETER PINION
5 LARGE-DIAMETER PINION
7 FIRST RACK
8 SECOND RACK
9 RACK MEMBER
10 RACK MEMBER

What is claimed is:

1. A damping mechanism comprising:

a damping body installed with a damper mechanism;

a rotative shaft protruding from said damping body;

a plurality of pinions provided on said rotative shaft and each having a different diameter from one another; and a plurality of rack members, each one of said rack members respectively engaging with one of said pinions thereby controlling the speed of the movement of said rack members.

2. A damping mechanism for controlling the speed of movement of a door member, comprising:

a damping body mounted to a fixed frame including:

a shaft having a first portion protruding from said damping body and a second portion operatively coupled to said damping body, wherein said shaft is structured and arranged to rotate within said damping body; and a damper mechanism structured and arranged to operatively couple said shaft to said damping body, whereby said damper mechanism controls an ability of said shaft to rotate freely within said damping body;

a plurality of pinions structured and arranged on said first portion of said shaft protruding from said damping body, said plurality of pinions being spaced from one another in a direction relative to a central axis of said shaft and each having a diameter different from one another; and a plurality of rack members attached to said door, wherein each of said rack members are structured and arranged to engage a respective one of said plurality of pinions thereby controlling the speed of the movement of said door.

3. The damping mechanism according to claim 2, wherein said plurality of pinions comprises:

a first pinion operatively coupled to said protruding portion of said shaft;

a second pinion operatively coupled to said protruding portion of said shaft and having a diameter larger than said first pinion;

wherein said plurality of rack members comprises:

a first rack member attached to said door and structured and arranged to engage said first pinion; and a second rack member attached to said door at an end of said first rack member, said second rack member being structured and arranged to engage said second pinion when said first pinion is out of engagement with said first rack member.

4. The damping mechanism according to claim 2, wherein said plurality of pinions comprises:

a first pinion operatively coupled to said protruding portion of said shaft;

a second pinion operatively coupled to said protruding portion of said shaft and having a diameter larger than said first pinion;

wherein said plurality of rack members comprises:

a fan shaped rack mounted on said door, said fan shaped rack including:

a first rack member structured and arranged to engage said first pinion; and a second rack member formed at an end of said first rack member and structured and arranged to engage said second pinion when said first pinion is out of engagement with said first rack member.

5. The damping mechanism according to claim 2, wherein said plurality of pinions comprises:

a first pinion operatively coupled to said protruding portion of said shaft;

a second pinion operatively coupled to said protruding portion of said shaft and having a diameter larger than said first pinion;

wherein said plurality of rack members comprises:

a first arcuate rack member projecting from said door and structured and arranged to engage said first pinion; and a second arcuate rack member formed at an end of said first rack member and projecting from said door, wherein said second arcuate rack member is structured and arranged to engage said second pinion when said first pinion is out of engagement with said first rack member.

* * * * *